United States Patent [19]

Schneider et al.

[11] 4,156,301

[45] May 29, 1979

[54] BASE PLATE FOR CONCEALED HINGES

[75] Inventors: Eberhard Schneider; Theo Vitt, both of Cologne, Fed. Rep. of Germany

[73] Assignee: Prämeta Präzisionsmetall- und Kunststofferzeugnisse G. Baumann & Co., Cologne, Fed. Rep. of Germany

[21] Appl. No.: 877,716

[22] Filed: Feb. 14, 1978

[30] Foreign Application Priority Data

Feb. 23, 1977 [DE] Fed. Rep. of Germany ..... 7705465

[51] Int. Cl.[2] ..... E05D 7/04

[52] U.S. Cl. ..... 16/131

[58] Field of Search ..... 16/1 R, 151, 129, 130, 16/131, 132, 133, 134

[56] References Cited

U.S. PATENT DOCUMENTS

| | | | |
|---|---|---|---|
| 403,572 | 5/1889 | Boda | 16/131 UX |
| 1,144,057 | 6/1915 | Pearson et al. | 16/130 X |
| 2,027,888 | 1/1936 | Solomon | 16/130 |
| 2,581,104 | 1/1952 | Houlsby, Jr. | 16/129 |
| 2,615,194 | 10/1952 | Kreiner | 16/129 |
| 3,908,226 | 9/1975 | Read et al. | 16/130 |
| 3,932,913 | 1/1976 | Johnson | 16/130 |

FOREIGN PATENT DOCUMENTS

| | | | |
|---|---|---|---|
| 1759642 | 7/1971 | Fed. Rep. of Germany | 16/129 |

*Primary Examiner*—Werner H. Schroeder
*Assistant Examiner*—Moshe I. Cohen
*Attorney, Agent, or Firm*—Diller, Ramik & Wight

[57] ABSTRACT

This disclosure relates to a base plate for a concealed hinge which includes a main plate portion having a longitudinal axis and a pair of projecting plate portions each having a longitudinal axis and projecting from opposite sides of the main plate portion to define a generally T-shaped configuration with aperture means of an oblong shape in one of the projecting plate portions having a major axis in transverse relationship to the main plate portion longitudinal axis, and the projecting plate portion having the latter aperture means including a plurality of teeth in generally parallel relationship to each other and to the main plate portion longitudinal axis and being in meshed relationship with opposing teeth of a washer having an opening with a screw adapted for passage through the opening and the aperture means.

2 Claims, 2 Drawing Figures

BASE PLATE FOR CONCEALED HINGES

This invention is directed to a base plate for a concealed hinge and particularly for a furniture hinge which includes link or hinge rods connected directly or indirectly to the base plate.

Conventional base plates for hinges of the type set forth may include a longitudinal portion and transversely projecting portions at both sides thereof to impart a generally T-shaped configuration to the base plate. The projections are provided with holes through which pass fixing screws, bolts or like conventional fastening means. Such base plates are generally used in association with furniture having a series of holes spaced a predetermined distance from each other. The series of holes are drilled or stamped in the frame of the piece of furniture but the distances therebetween are not always true to measure or can change if the furniture is made from wood and is subject to changing atmospheric conditions. The latter causes difficulties in securing the cross-shaped or T-shaped base plates to furniture frames.

In keeping with the foregoing, it is a primary object of this invention to provide a novel base plate of the type set forth heretofore wherein the base plate can be readily secured to a furniture frame irrespective of dimensional deviations between prefabricated series of holes in the frame for securing the base plate thereto by conventional screws, bolts or the like.

In keeping with the present invention, the base plate includes in at least one of a pair of projecting plate portions thereof an oblong aperture having a longitudinal or major axis transversed to a longitudinal axis of a main plate portion of a base plate, and teeth carried by the projecting plate portion in parallel relationship to the main plate portion longitudinal axis and in mesh with a like plurality of teeth of a washer with the intermeshed teeth being held in fixed relationship by a screw retained in an appropriate opening of a furniture frame.

By constructing a base plate for a hinge in the manner just described, it is possible that the base plate even with differences between the holes of a series of holes of the furniture frame or the like can be fixed without difficulties and, at the same time, the alignment of the base plate in a direction to an imaginary line connecting the series of hole is ensured. The intermeshing teeth permit simple and safe parallel displacement of the base plate when the latter is being fixed to the frame whether the latter is made of wood or metal. By slightly releasing the screw which affixes the base plate to the frame, the door leaf or the like which is hung by the hinge can not move downwardly because there is still a connection between the washer and the base plate by means of the intermeshed plurality of teeth. Thus, the alignment of the base plate and the series of holes with the displacement of the base plate for an adjustment in height of the door leaf is essentially facilitated. Moreover, a safe mounting of the base plate by screws, bolts or like fastening means is readily realized.

In keeping with a further object of this invention cooperative guide surface means are provided between the washer and the screw for accurately locating the latter elements relative to each other, and the latter-noted cooperative guide surface means are in the form of an annular conical or cylindrical shank portion of the screw and a similarly dimensioned opening of the washer. By the latter structure, a correct guidance of the washer relative to the base plate is achieved by means of the screw, bolt or like fastening means.

In accordance with another object of this invention each of the projecting plate portions preferably includes a pair of spaced upstanding generally parallel ribs disposed in transverse relationship to the plurality of teeth and the main plate portion longitudinal axis for accurately guiding the movement of the washer along its associated projecting plate portion. The pair of ribs in conjunction with the washer also reduces and/or limits to a minimum the play between the washer and the projecting plate portion as well as such play of the latter elements relative to the screw, bolt or like conventional fastening means. Thus, all three elements and their interfitting relationship is exactly predetermined.

By constructing a base plate in the manner set forth herein, one merely has to apply axial pressure along the longitudinal axis of the screw for positioning the base plate relative to the furniture frame. Thus, displacement in a cross or longitudinal direction relative to the base plate is no longer possible and frictional contact is not established. In other words, the screw need only be slightly tightened during assembly and final seating while the risk of overtightening or overturning the screw is eliminated while a firm seating of the components is ensured.

It is further advantageous for the pair of ribs and a cross rib therebetween to form a recess within which rests and is guided the washer as a result of which the position of the washer with respect to the projecting plate portion is established or defined to ensure parallel displacement of the base plate when secured or being secured to a furniture frame.

With the above and other objects in view that will hereinafter appear, the nature of the invention will be more clearly understood by reference to the following detailed description, the appended claims and the several views illustrated in the accompanying drawings.

IN THE DRAWINGS

Figure 1:
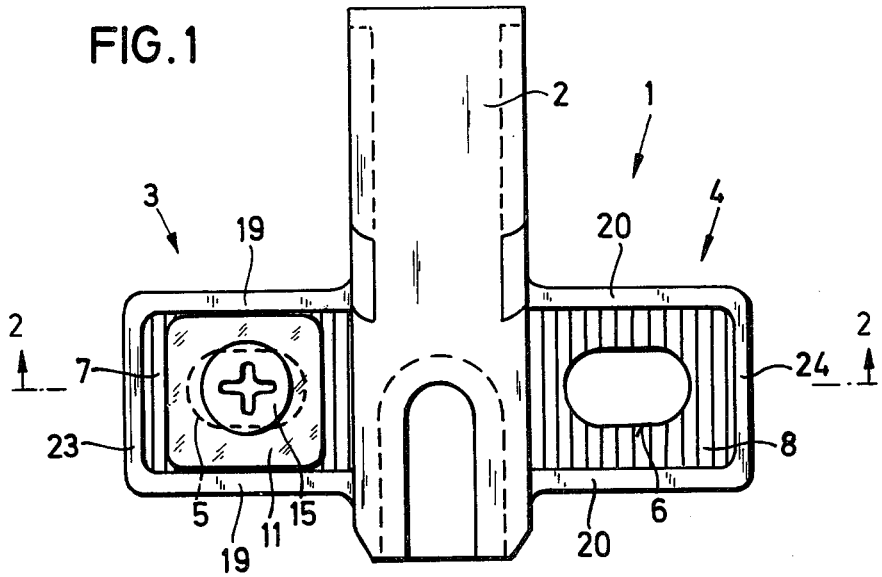
FIG. 1 is a top plan view of a novel base plate constructed in accordance with this invention and illustrates a main plate portion and a pair of projecting plate portions, the latter of which each includes a plurality of parallel teeth and an oblong opening with an associated washer and screw being shown associated with the left hand projecting plate portion.

A novel base plate constructed in accordance with this invention is generally designated by the reference numeral 1 and is preferably designed for association with a concealed furniture hinge. The base plate 1 is constructed from metallic or plastic material and includes a main plate portion 2 having a longitudinal axis (unnumbered) and a pair of laterally projecting plate portions 3, 4 each of which likewise has a longitudinal axis (also unnumbered) which is transverse or normal to the longitudinal axis of the main plate portion 2. At least one, but preferably both, of the projecting plate portions 3, 4 have respective elongated or oblong aperture means, openings, or slots 5, 6 whose major axes (not shown) are likewise in transverse or normal relationship to the longitudinal axis of the main plate portion 2 and include a plurality of teeth 7, 8, respectively, which are parallel to each other and parallel to the longitudinal axis of the main plate portion.

Generally rectangular washers 11, 12 having bored and counterbored aperture means or openings 17, 18 for the receipt of respective screws 9, 10 are associated with the respective plate portions 3, 4 and have each a plurality of teeth 13, 14 which intermesh with the teeth 7, 8 of the projecting plate portions 3, 4.

The screws 9, 10 include heads (unnumbered), adjacent guide means in the form of cylindrical or conical shoulder portions 15, 16 and threaded ends (unnumbered). The portions 15, 16 are of a diameter or maximum diameter corresponding to the diameter of the bores 17, 18 of the washers 11, 12 to accurately locate the screws 15, 16 with respect to the associated washers 11, 12.

The washers 11, 12 are guided between upwardly directed, spaced, longitudinal ribs 19, 19 and 20, 20 which are transverse or normal to the longitudinal axis of the main plate portion and are interconnected at terminal ends (unnumbered) of the projecting plate portions 3, 4 by like upstanding ribs 23, 24, respectively. The washers 11, 12 are rectangular in configuration (FIG. 1) and fit with relatively little play within recesses 21, 22 defined by the walls 19, 19, 23 and 20, 20, 24 of the respective projecting plates portions 3, 4. Thus, the recesses 21, 22 and the ribs or walls 19, 19 and 20, 20 guide the sliding motion of the washers 11, 12 from left-to-right, as viewed in FIGS. 1 and 2 and limit up and down motion (FIG. 1) or motion parallel with the longitudinal axis of the main plate portion 2.

Figure 2:
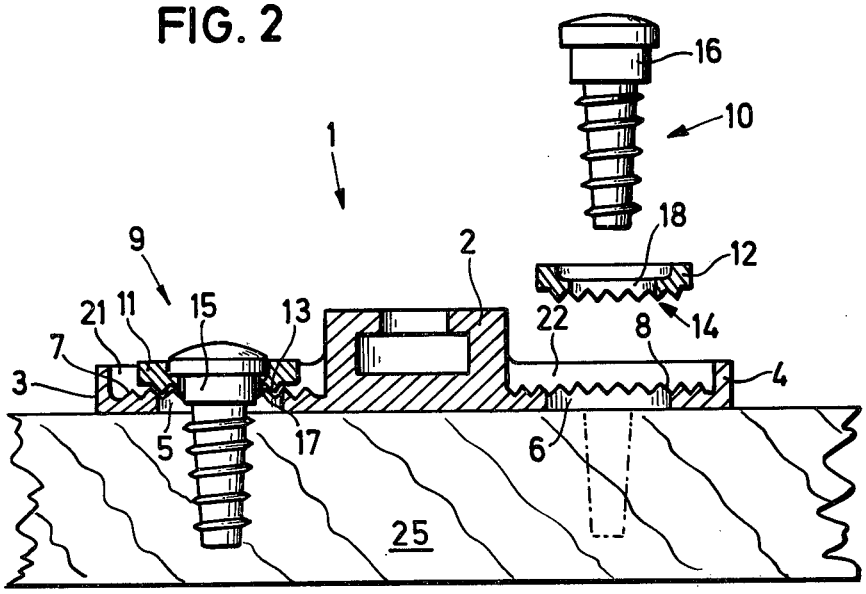
FIG. 2 is a fragmentary sectional view taken generally along line 2—2 of FIG. 1 and illustrates an additional washer and screw prior to assembly with the base plate and an associated furniture frame.

The base plate 1 is secured to a wood, metal or like furniture frame 25 in the manner readily apparent from FIG. 2 in which the screw 15 is shown threaded in a pre-bored hole (unnumbered) spaced a distance which is predetermined from a like bored hole, shown unnumbered and in phantom outline in FIG. 2, for receiving the screw 10. If the distance between the holes and the frame 25 is not accurate, the washer 12 may be moved to the left or to the right until the axis of the opening or aperture 18 and that of the screw 10 is aligned with the bore or hole in the frame 25 after which the screw 16 is tightened so that the teeth 14, 8 are locked in accurate meshed relationship. In this manner, the base plate ensures that there is absolute parallel displacement of the base plate with only a slight release (unthreading) of the screws 9, 10 with the parallel position being automatically adjusted upon the tightening of the screws 9, 10. With a slight release of the screws 9, 10 a door leaf (not shown) hanging from a hinge associated with the base plate 1 does not move immediately downward but still held in position by the intermeshed relationship of the teeth 13, 7 and 14, 8. As a result, alignment and adjustment of the base plate 1 relative to the holes (unnumbered) in the frame 25 or for the adjustment of the height of the door leaf can be performed accurately, quickly, and repeditively.

Although only a preferred embodiment of the invention has been specifically illustrated and described herein, it is to be understood that minor variations may be made without departing from the spirit and scope of the invention, as defined in the appended claims.

We claim:

1. A base plate for a concealed hinge comprising a main plate portion having a longitudinal axis and a pair of projecting plate portions each having a longitudinal axis in transverse relationship to said main plate portion longitudinal axis, said pair of projecting plate portions project from opposite sides of said main plate portion thereby defining a generally T-shaped configuration to said base plate, aperture means in each of said projecting plate portions for receiving therethrough an associate screw, said aperture means each being of an oblong shape and having a major axis in transverse relationship to said main plate portion longitudinal axis, said projecting plate portions each having a plurality of teeth in general parallel relationship to each other and to said main plate portion longitudinal axis, a washer associated with each projecting plate portion and each washer having an opening, each washer beng in overlying relationship to an associated projecting plate portion, a plurality of teeth carried by each washer in meshed relationship with said first-mentioned plurality of teeth, a screw received through each aperture means and opening, cooperative guide surface means between each washer and its associated screw for accurately locating the latter elements relative to each other, each of said projecting plate portions having a pair of spaced upstanding ribs guidingly confining an associated washer for movement generally transverse to said main plate portion longitudinal axis, and each of said projecting plate portions having recess means in part defined by said pair of upstanding ribs for receiving and housing an associated washer and augmenting the guiding movement of said washers generally transversely of said main plate portion longitudinal axis.

2. The base plate as defined in claim 1 including another upstanding rib interconnecting each pair of upstanding ribs remote from said main plate portion whereby said washers can not be removed from said projecting plate portions by movement thereof transverse to said main plate portion longitudinal axis.

* * * * *